US007748333B2

(12) United States Patent
Pohle

(10) Patent No.: US 7,748,333 B2
(45) Date of Patent: Jul. 6, 2010

(54) CARGO SKIFF

(76) Inventor: Daniel L. Pohle, 1280 N. Co. Rd., 500 E., Butlerville, IN (US) 47223

( * ) Notice: Subject to any disclaimer, the term of this patent is extended or adjusted under 35 U.S.C. 154(b) by 0 days.

(21) Appl. No.: 12/175,824

(22) Filed: Jul. 18, 2008

(65) Prior Publication Data

US 2010/0012007 A1 Jan. 21, 2010

(51) Int. Cl.
*B63B 35/28* (2006.01)

(52) U.S. Cl. ..... 114/26; 114/65 R; 114/355

(58) Field of Classification Search ..... 114/26, 114/72, 355, 65 R, 77 R; 441/35
See application file for complete search history.

(56) References Cited

U.S. PATENT DOCUMENTS 1,807,714 A * 6/1931 Taylor ..... 114/26
2,594,930 A * 4/1952 Hudson ..... 114/26
3,448,711 A * 6/1969 Kersteter et al. ..... 114/26
3,831,212 A 8/1974 Moore et al.
3,903,822 A * 9/1975 Le Grand et al. ..... 114/26

FOREIGN PATENT DOCUMENTS

FR A-2529338 12/1983

* cited by examiner

*Primary Examiner*—Lars A Olson
(74) *Attorney, Agent, or Firm*—Bose McKinney & Evans LLP

(57) ABSTRACT

A boat including a having a first side, a second side, a bottom coupled to the first side and the second side. Each of the first and second sides and bottom can include a plurality of hollow beams welded along seams to form a double hulled boat.

20 Claims, 10 Drawing Sheets

CARGO SKIFF

BACKGROUND

The present invention relates to an improved double-hulled boat or skiff that is made from hollow beams and can be stacked in quantities for mass distribution.

Double-hulled boats are presently known and can be made of a fiberglass material. These boats are generally suited for carrying people engaging in recreational activities, such as leisure boating and fishing.

SUMMARY OF THE INVENTION

The present invention relates to the construction and design of a cargo skiff. In an exemplary embodiment, the cargo skiff comprises a plurality of hollow beams with end caps welded to each end of every beam and the plurality of beams are then welded together to form the cargo skiff. Adjoining beams form an I-beam construction which provides a more durable and stronger cargo skiff. Further, the beams form a double-hulled cargo skiff such that if either the inner or outer hull is damaged, the remaining undamaged portions of the hull prevent water or other fluid from leaking into the cargo skiff.

The front or bow of the cargo skiff includes vertical front posts and the rear or stern includes rear posts. Additionally, a fuel tank assembly for holding fuel is provided towards the stern of the skiff. A motor may be mounted near the stern and fuel lines may connect the motor to the fuel tank assembly.

The size and shape of the cargo skiff is such that it may fit within a 40 feet by 90 inch ocean container and may be transported overseas. Further, a plurality of cargo skiffs can be stacked on top of one another to allow multiple cargo skiffs to be arranged within an ocean container. The cargo skiff may weigh approximately 5,000 pounds with a payload capacity of 5 tons. The dimensions, weight, and payload capacity may differ depending on the type of cargo being transported and thus the values provided above are only given as an example of one embodiment of the cargo skiff.

Additional features and advantages of the invention will become apparent to those skilled in the art upon consideration of the following detailed description of the illustrated embodiments.

BRIEF DESCRIPTION OF THE DRAWINGS

The above-mentioned aspects of the present invention and the manner of obtaining them will become more apparent and the invention itself will be better understood by reference to the following description of the embodiments of the invention, taken in conjunction with the accompanying drawings, wherein.

DETAILED DESCRIPTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
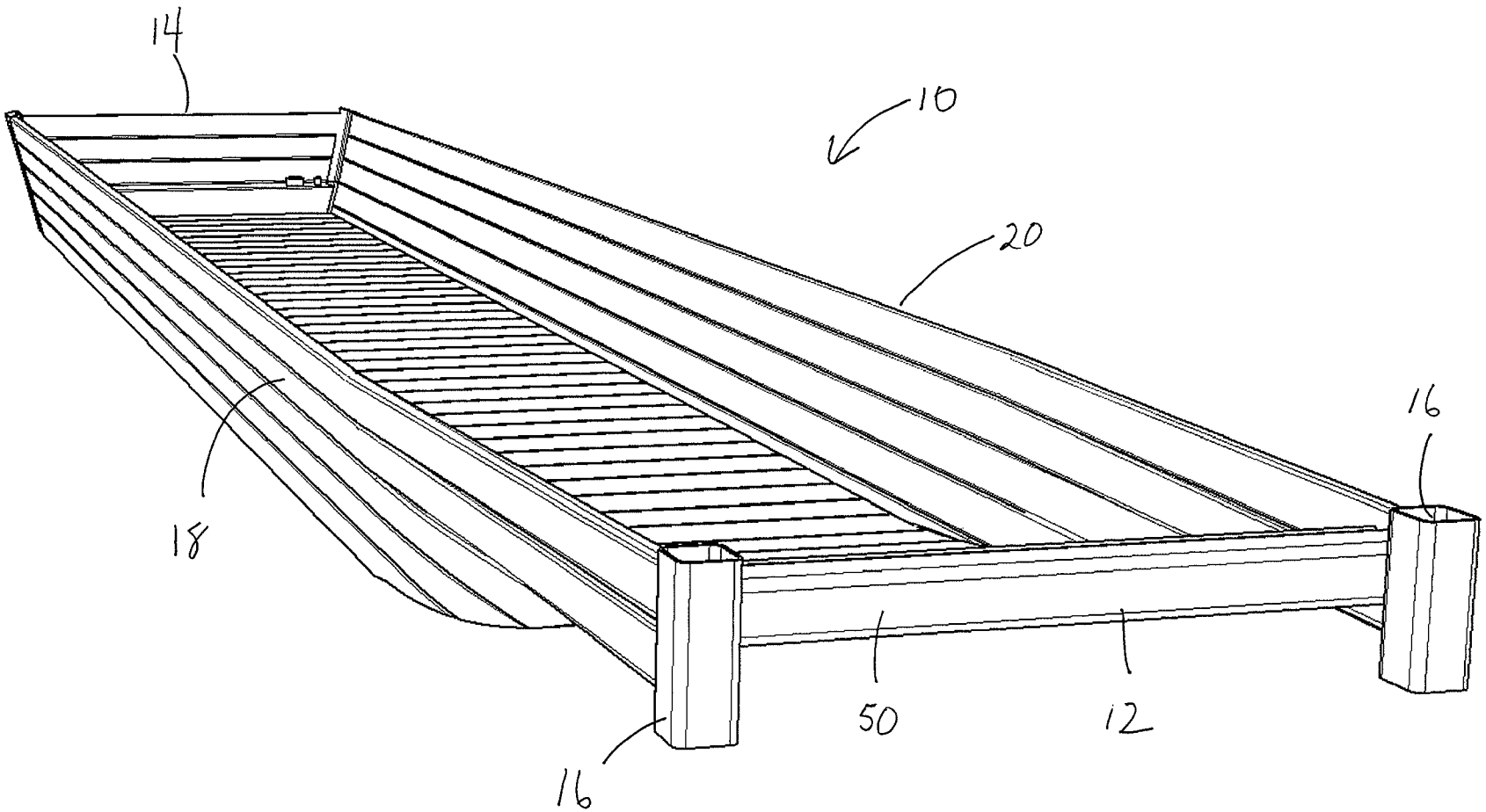
FIG. 1 is a perspective view of a cargo skiff.

An exemplary embodiment of a boat or cargo skiff is shown in FIG. 1. The cargo skiff 10 includes hull having a bow or front end 12, a stern or back end 14, a starboard or right side 18, and a port or left side 20. Vertical posts 16 are positioned at the front corners of the bow 12 to add rigidity and strength to the cargo skiff 10. As will be described in further detail below, the cargo skiff 10 is built with a plurality of hollow beams that are closed at both ends with end caps and the plurality of beams are connected together along the seams to construct a lightweight, double-hulled skiff capable of transporting heavy cargo along bodies of water.

Figure 2A:
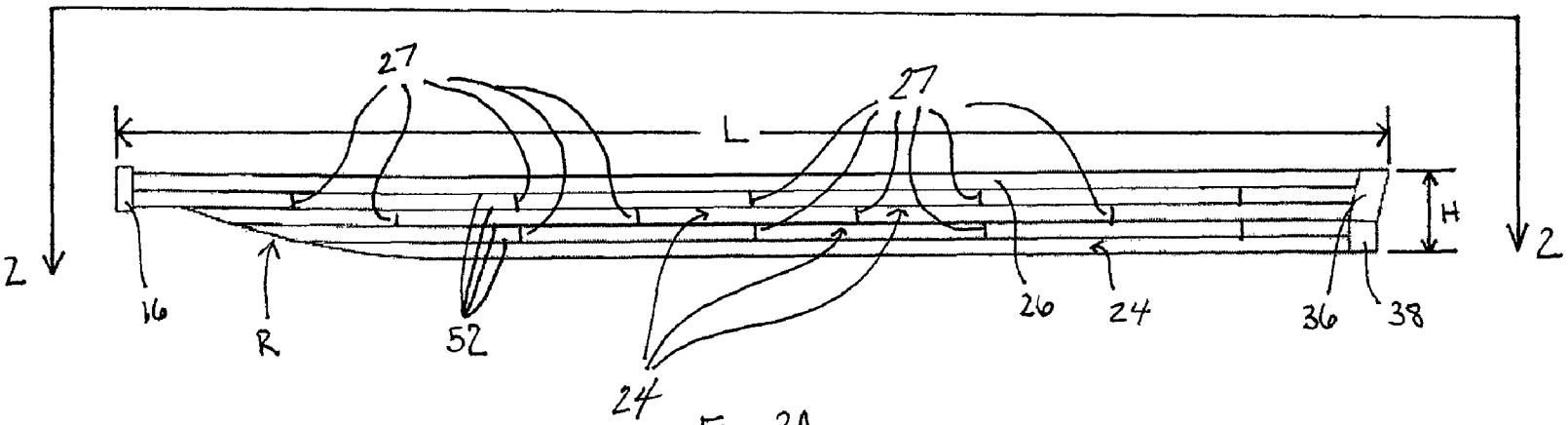
FIG. 2A is a side view of the cargo skiff of FIG. 1.

The length L of the cargo skiff 10 is generally less than 40 feet. In one embodiment, the length is 39 feet, 6 inches. However, the length of the skiff can vary depending on the type of cargo being transported and the means for transporting the skiff prior to use. For example, as illustrated in FIG. 2A, the cargo skiff 10 can be constructed to a length L that fits within a 40 foot ocean container for transporting the skiff to different parts of the world. The height H of the cargo skiff 10 can also vary depending on the type of cargo being transported. Along with the length L, the height H should be sufficient to allow adequate water displacement for carrying the cargo. For example, in one embodiment, the height H may be approximately 30 inches. Additionally, the height H may also depend on the means for transporting the skiff prior to use. The height H may be selected such that several skiffs can be stacked on top of one another and then placed into an ocean container for transporting overseas. In general, ocean containers have an opening with a 90 inch width for inserting the stacked skiffs therein. It is possible to construct the cargo skiffs such that 4 or more skiffs can be stacked and inserted into the ocean container.

Figure 3:
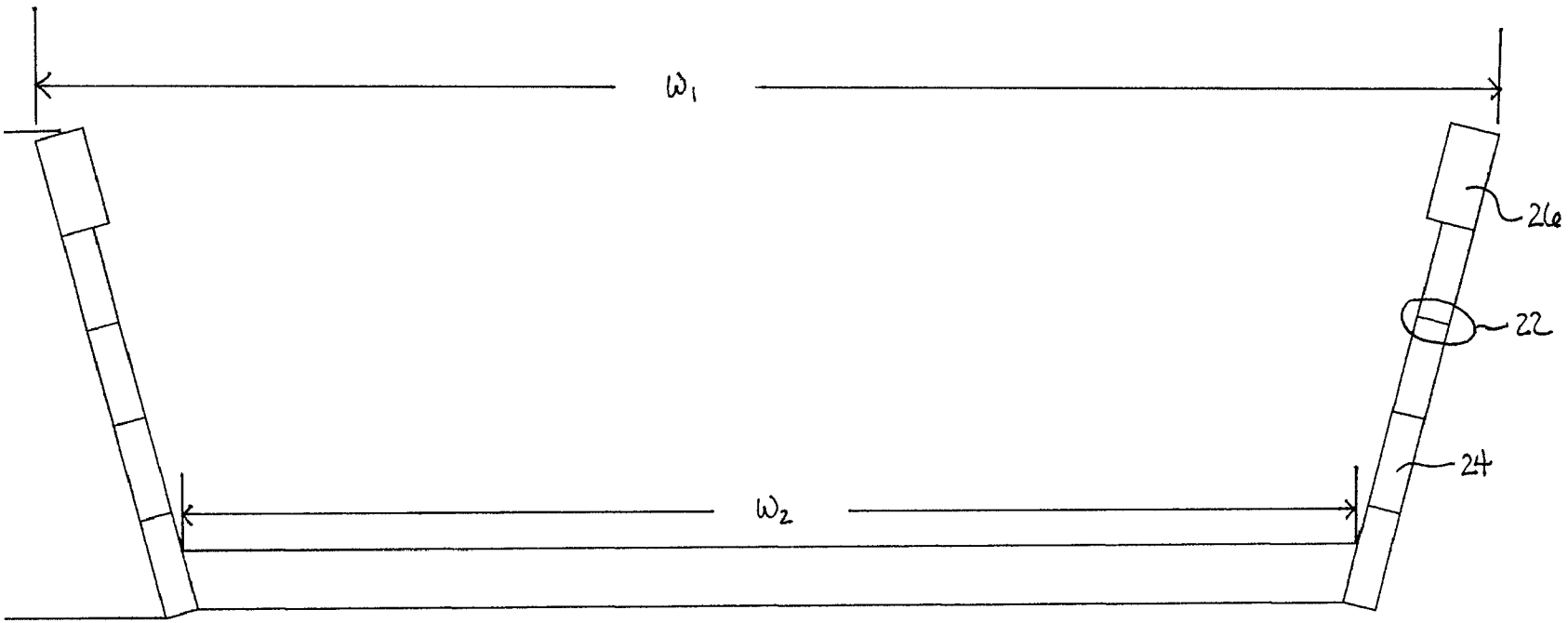
FIG. 3 is a cross-sectional view along a line 3-3 of FIG. 2B without the back end.

In FIG. 3, the cross section of the cargo skiff 10 is shown along lines 3-3 of FIG. 2A. In particular, the cargo skiff has both an inner width W2 and an outer width W1. In one embodiment, the inner width W2 is approximately 6 feet and the outer width W1 is almost 7.5 feet. In a specific embodiment, W1 is 89.8 inches (7.483 feet) and W2 is 72.3 inches (6.025 feet). As described above with respect to the length L and height H, the widths W1 and W2 may vary and depend on various factors including the type of cargo being transported, water displacement by the loaded skiff, the means for transporting the cargo skiff prior to use, and the ability to stack multiple skiffs together and transport them in a single operation. In another embodiment, the width W1 may be greater than 10 feet. For instance, the inside width, W2, of approximately seventy-two inches allows transport of many sports utility vehicles (SUV).

Figure 4:
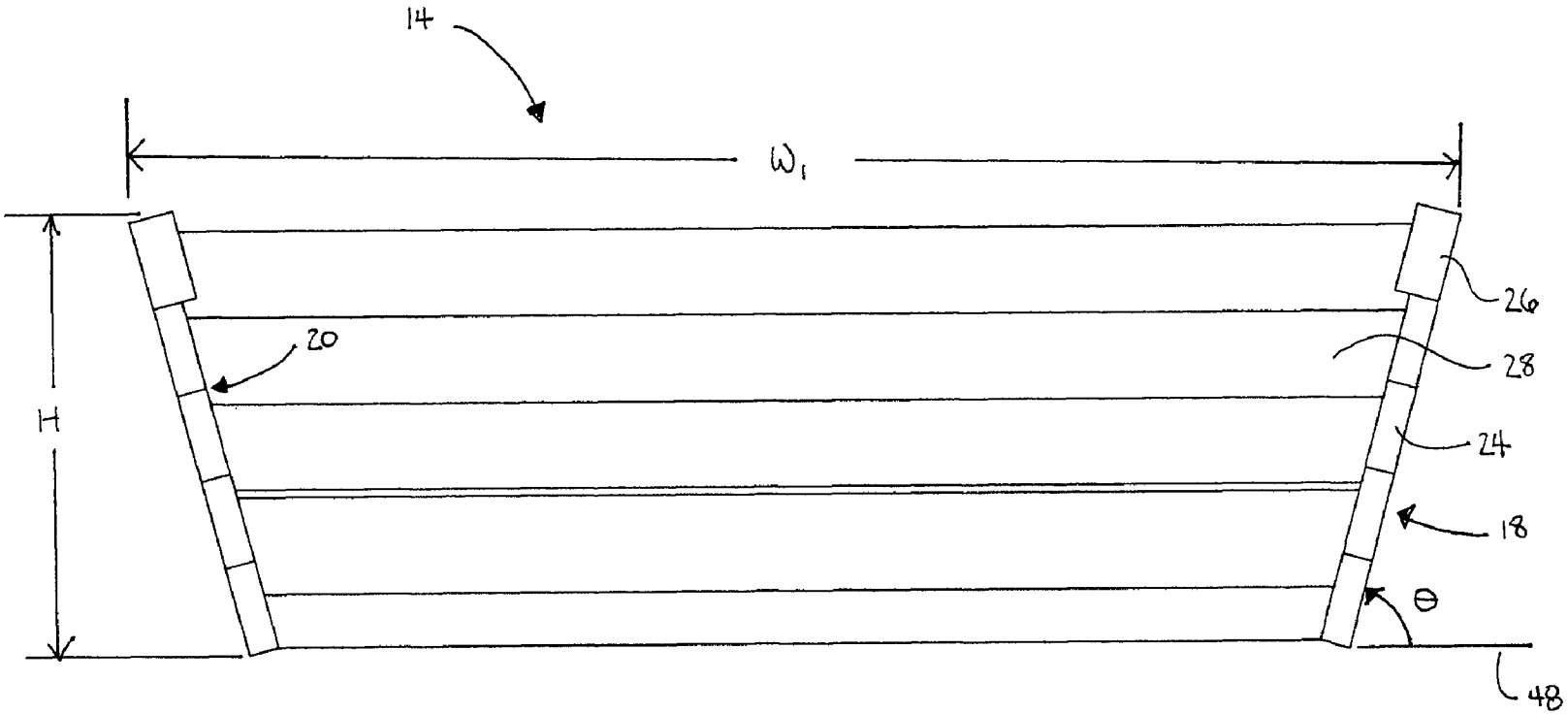
FIG. 4 is a cross-sectional view along a line 3-3 of FIG. 2B including the back end.

In FIG. 4, the stern 14 is shown with both the starboard 18 and port 20 sides being angled at θ degrees. The angle θ can vary between, but is not limited to, ten degrees and thirty degrees. In one embodiment, the angle θ is fifteen degrees with respect to vertical using the bottom of the boat to define horizontal. One advantage associated with the angled sides is it allows the cargo skiffs to be stacked on top of and partially within one another such that the body of one skiff fits within the interior cavity of a second skiff. As noted above, stacking several skiffs together allows multiple skiffs to be transported in the same shipment.

The cargo skiff 10 is designed such that it can weigh approximately 5,000 pounds in some embodiments. This weight can vary depending on several factors including the type of cargo being transported and the overall design of the skiff, and therefore 5,000 pounds is merely an exemplary weight of one embodiment. The rigid design of the cargo skiff 10 can haul cargo loads of at least 5 tons in various embodiments. When fully loaded, the cargo skiff 10 may have a draft of 13 inches with respect to the water level.

To achieve a lightweight and durable cargo skiff, a plurality of hollow beams are coupled together to form the structure. In an exemplary embodiment, these beams may comprise steel box tubing having both square and rectangular cross-sections. Steel box tubing is available from a variety of manufacturers or distributers, such as Alro Steel of Indianapolis, Ind. Other materials may be used to construct the cargo skiff in different embodiments and steel box tubing should not be limiting.

Figure 2B:
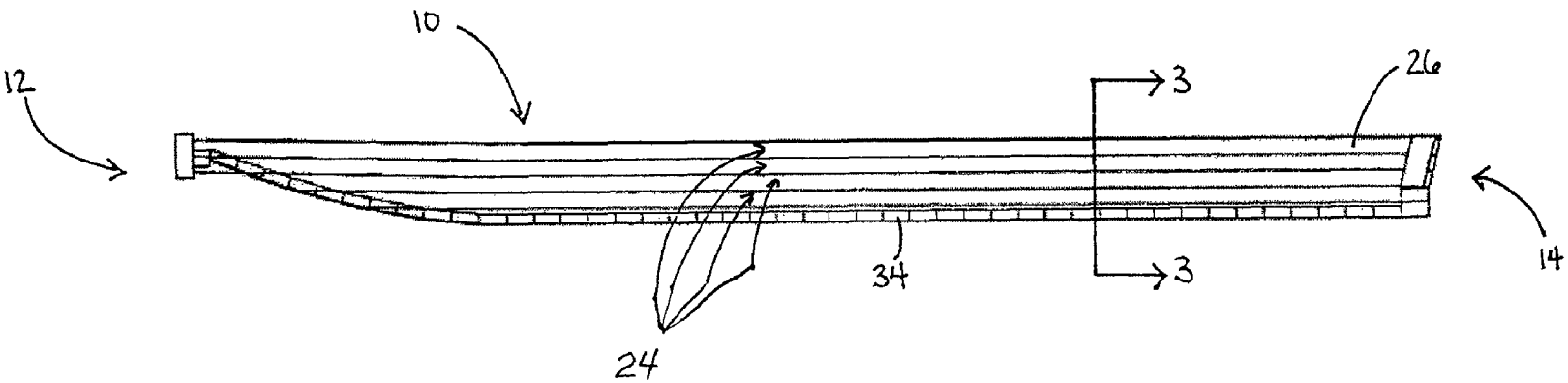
FIG. 2B is a cross-sectional side view along a line 2-2 of FIG. 2A.

In the embodiment of FIGS. 2A and 2B, different beams can be used to construct the starboard and port sides of the cargo skiff. Specifically, in FIG. 2B, the side comprises four rows of side beams 24 and one row of top beam 26 which extend longitudinally along the length L of the cargo skiff. Depending on the desired height of the cargo skiff, a different embodiment may include additional or fewer side beams 24. Each side beam 24 and top beam 26 may comprise one or more individual beams 24 that define the length L of the skiff. For example, each side beam can include multiple side beams 24 joined together at a vertically welded seam 27. The vertically welded seams 27 can be staggered along the length of the skiff with respect to one another to provide rigidity such that vertical seams between adjacent individual side beams 24 are not aligned. While only some of the vertically welded seams are illustrated, some or all side beams 24 and 26 can include multiple side beams welded at seams 27. It is within the scope of the present invention for a row to include a single side beam extending the length of the boat, where the intended use of the boat does not require as much strength. Using more individual side beams along the length of a single row provides for greater strength.

At the bow 12 of the cargo skiff 10, a plurality of vertical posts 16 may be positioned at each corner (similar to FIG. 1) to provide additional strength. Each of the individual side beams 24 are connected to one another and may be connected to the posts 16. The uppermost side beam 24 is also connected to the top beam 26. In one embodiment, top beam 26 may have slightly larger dimensions than the side beams 24, but this may not be the case in other embodiments. As shown in FIG. 2A, the side beams 24 may also connect to a plurality of floor beams 34 that form the bottom surface of the cargo skiff 10.

Towards the bow 12 of the skiff, the plurality of floor beams 34 are arranged such that the skiff has a curved shape. In one embodiment, the radius R of this curvature is approximately 320 inches taken with respect to a center point of a circle having the curved hull defining the outer circumference of the circle. The skiff may have a curvature R between 300 inches to 600 inches. A longer radius allows the craft to plane and to bank better in shallow water. The longer radius however can reduce the displacement and/or the carrying capacity. The floor beams 34 are arranged substantially transverse to the length L of the cargo skiff 10. This arrangement provides additional strength and durability to the skiff.

Towards the stern 14 of the cargo skiff 10, the plurality of side beams 24 and top beam 26 are connected to a plurality of end beams. The end beams may comprise an upper rear post 36 and/or a lower rear post 38. The upper rear post 36 tilts toward the back of the boat at approximately fifteen degrees from vertical. The lower rear post 38 is substantially vertical. A fuel tank 42 is located between the left and right lower rear posts 38 to be described in more detail below.

In FIG. 4, the stern 14 of the cargo skiff 10 is shown with the plurality of side beams 24 and top beam 26 coupled to a plurality of rear beams 28. The plurality of rear beams 28 connect to the plurality of side beams 24 and top beam 26 at the starboard 18 and port 20 sides such that the sides of the cargo skiff are generally angled θ degrees from the horizontal axis 48. The bottom two side beams 24 of each side are connected to the respective lower rear posts 38 with the coupled ends being substantially vertical. (See FIG. 2A and FIG. 9) The remaining side beams 24 of each side are respectively coupled to the upper rear posts 36 at fifteen degrees from vertical to match the angle of the upper rear post. Even though the lower two side beams 24 have ends substantially vertical, the sides 18 and 20 are generally fifteen degrees (θ) from vertical.

The various beams described above may have different shapes and sizes. For example, in one embodiment, the plurality of individual side beams 24, top beam 26, plurality of floor beams 34, and rear beams 28 may comprise rectangular steel box tubing. In this embodiment, the plurality of individual side beams 24 and rear beams 28 may be 2" wide×6" high×11 gauge. Top beam 26 may be 3"×6"×11 gauge steel tubing. The plurality of floor beams 34 may be 3"×10"×11 gauge steel tubing. Beams 36 may be 3"×10"×11 gauge steel tubing. Beams 38 may be 3"×10"×11 gauge steel tubing. In other embodiments, the plurality of side beams 24, top beam 26, floor beams 34, and rear beams 28 may comprise different sizes and/or materials. Further, portions of the cargo skiff may comprise square steel box tubing. In one such embodiment, the posts 16, square beam 38, fuel tank 42, and forwardmost cross beam 50 (FIG. 1) may be square hollow beams. The fuel tank 42 may be 10"×10"×7 gauge steel tubing and the posts 16 and forwardmost cross beam 50 may be 6"×6"×0.375 gauge steel tubing. The sizes of each beam are given only as one possible embodiment and should not be limiting. In other embodiments, these sizes may vary based on different needs of the end user. Different sizes of tubing with smaller or greater heights and/or widths and/or lengths can be used to create sides having shorter or taller side dimensions. If smaller height tubes are used, the sides would have a greater number of side beams 24 along the vertical direction. If greater height tubes are used, the sides would have smaller number of side beams 24.

As described above, the various beams are connected to one another by various means. In one embodiment, the beams are welded together via metal inert gas (MIG) welding. In this embodiment, beads of weld are applied along the length of every seam formed by the interfacing corners extending the length of adjacent beams on both the interior and exterior portions of each side of the skiff. For example, each of the lines 52 of FIG. 2A can include a bead of weld along the entire length of the seam between adjacent beams. These welds are located at the edges and corners of adjacent beams, but not typically at the contacting surfaces located therebetween. In a preferred embodiment, substantially all accessible points of contact between adjacent individual beams are welded. Approximately 1400 linear feet of MIG welded seams are achieved in this embodiment which provides additional strength and durability to the cargo skiff. Other amounts of linear feet of welded seams are within the scope of the present invention. Also, by welding along the entire length of each beam, the cargo skiff is constructed with a water-tight seal. In a different embodiment, the beams may be spot-welded in some locations, but this reduces the strength of the cargo skiff and the effectiveness of the water-tight seal. Furthermore, continuous welding of all side seams provides for the I-beam strength throughout the craft.

Figure 5:
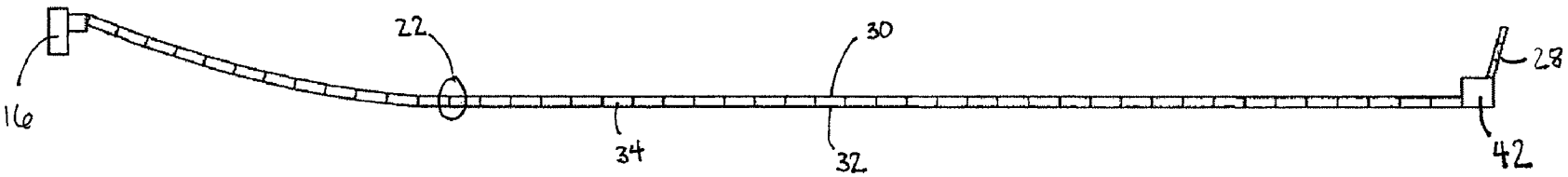
FIG. 5 is a partial cross-sectional side view of the cargo skiff of FIG. 1 without the side beams.

The cargo skiff design is advantageous because it creates a double-hulled construction. As shown in FIG. 5, the beams form an inner hull 30 and an outer hull 32. The double-hulled design is important if either the inner hull 30 or outer hull 32 is damaged, because the undamaged hull prevents water from leaking into the cargo skiff. Additionally, if only one beam is damaged, then only that damaged beam must be repaired or replaced. The surrounding beams may remain in place until the damaged beam is repaired or replaced and this can reduce the cost and the time required for fixing the damage.

Figure 8:
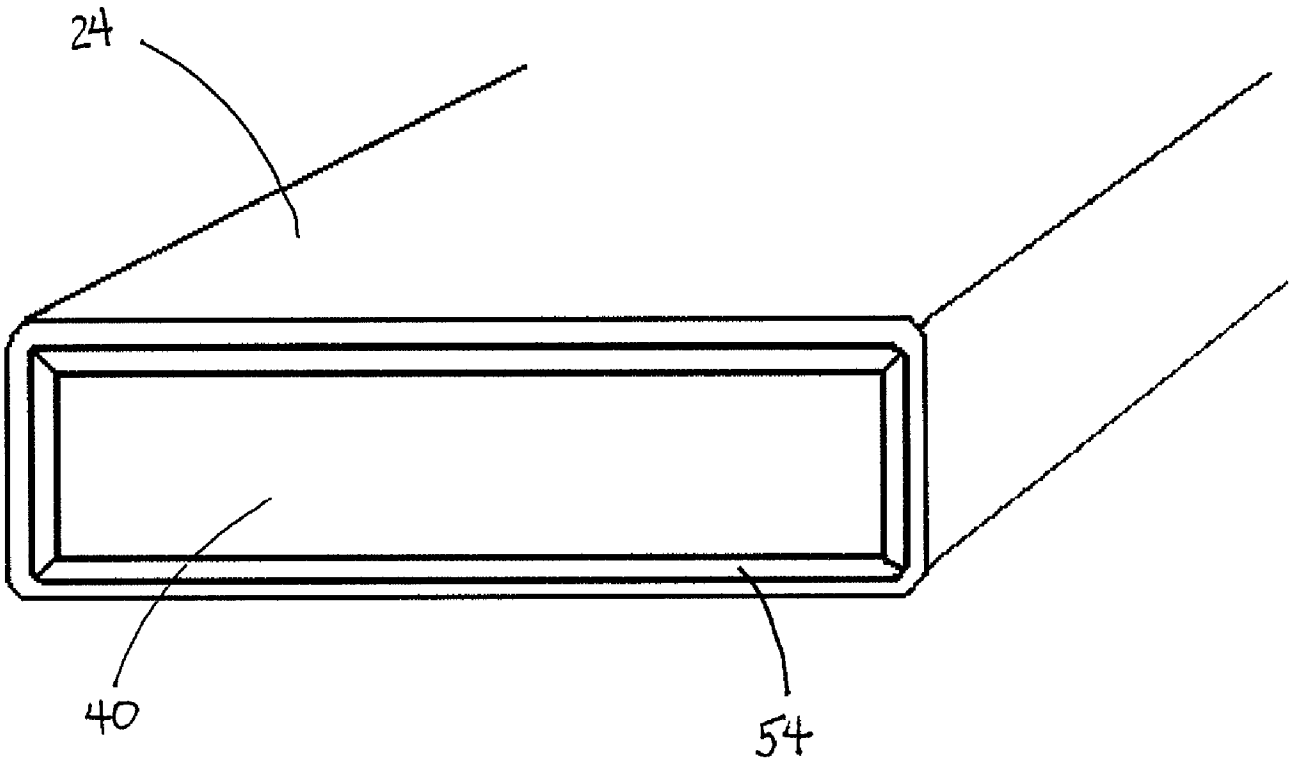
FIG. 8 is a partial perspective view of a beam with an end cap connected thereto.

In one exemplary embodiment, each end of every beam that forms the cargo skiff is closed at each end by an end cap 40. In the embodiment of FIG. 8, the end cap 40 is connected to the end of every individual side beam 24 to prevent any water or other fluid from leaking into the interior of the beam. Enclosing the ends of a beam forms a sealed rectangular "box" or unit, also known as a cuboid. In one embodiment, the skiff can include eighty or more separate cuboids. The number of cuboids used in a single boat can be more or less than eighty depending on the desired size and strength of the boat.

The end caps 40 can be welded, such as by MIG welding, to the ends of each beam to form the most durable construction. By capping the ends of each individual beam to provide the rectangular box, the torsional and longitudinal rigidity of each beam is enhanced. The end caps improve the ability of each individual to resist twisting forces. In other embodiments, however, the end caps can be joined to the open end of a beam by other means known to the skilled artisan including adhesive, heat sealing, etc.

In general, as the cargo skiff 10 is being built, each beam is capped at both ends with an end cap 40 and then the capped beams are connected to one another to form the cargo skiff 10. For instance, the entire length of a single side beam can be constructed of multiple shorter side beams, each of which is capped at both ends. Adjacent ends of the enclosed beams are welded to form one entire side beam. It is within the scope of the present invention to cap one end of a beam and not the end of an adjacent beam such that when welded together, the two adjacent beams share one end cap.

It is preferred that a single length of a side beam extending longitudinally from front to back includes two or more rectangular boxes (cuboids) connected at adjacent ends. In one embodiment of the present invention, every other single length of a side beam extending longitudinally from front to back includes the same number of rectangular boxes, while adjacent side beams include a different number of rectangular boxes. For instance, adjacent side beams can alternate between two and three rectangular boxes. Other numbers are within the scope of the present invention.

Figure 6:
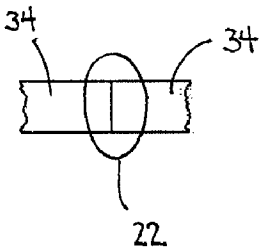
FIG. 6 is a cross-sectional view of two beams connected together forming an I-beam arrangement.
Figure 7:
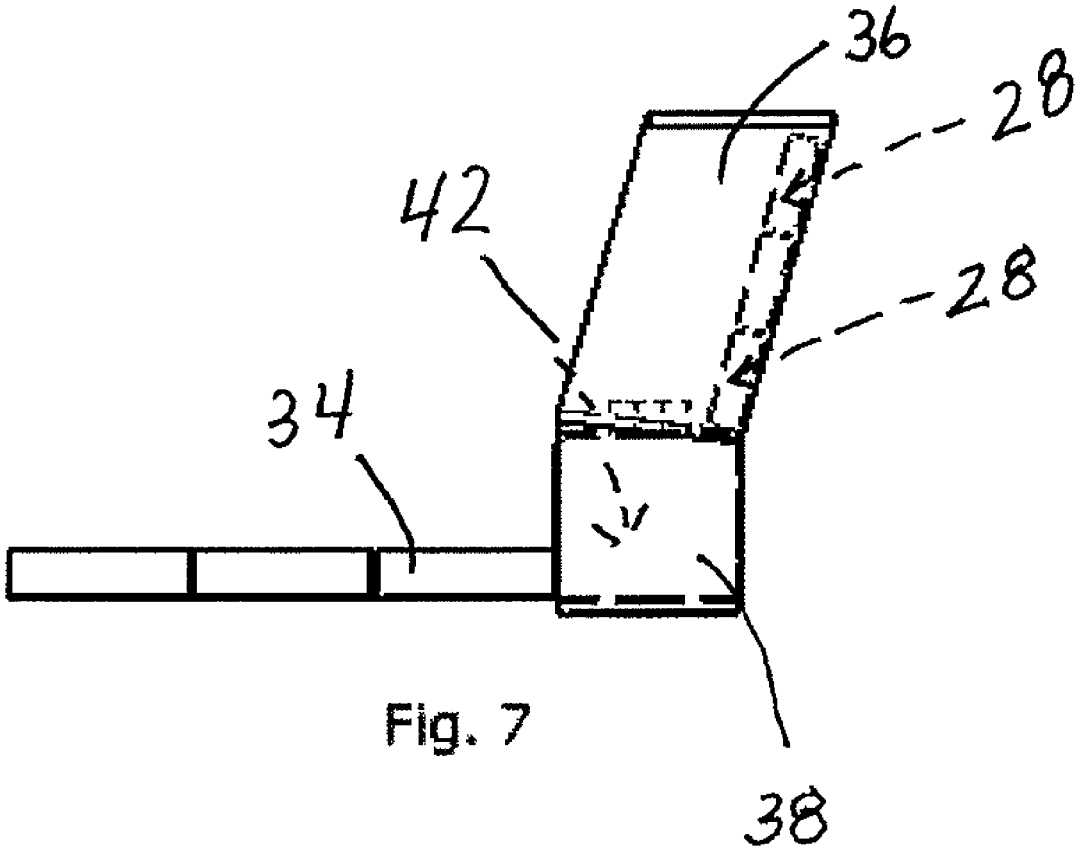
FIG. 7 is a side view of the fuel tank of FIG. 5.

The strength of the cargo skiff 10 can be further achieved by the formation of an I-beam design 22. Embodiments having this I-beam design 22 are shown in FIGS. 3, 5, and 6. In FIG. 3, for example, the I-beam design is shown between adjacent side beams 24. In FIGS. 5 and 6, the I-beam design 22 is shown between adjacent floor beams 34. In the exemplary embodiment in which the plurality of floor beams 34 are MIG welded together, the I-beam design 22 forms where the end caps 40 of two of the beams 34 are joined together.

Another advantage associated with various embodiments of the cargo skiff 10 is the inclusion of a fuel tank assembly 42. In the embodiment of FIG. 2B, for example, the fuel tank assembly 42 may be located between all or a portion of lower rear posts 38. As illustrated in FIG. 5, the fuel tank assembly 42 forms part of the stern 14 and is connected to at least one floor beam 34 and at least one rear beam 28. In other embodiments, the fuel tank assembly can sit at the intersection of the bottom and the back of the boat between the sides.

Figure 9:
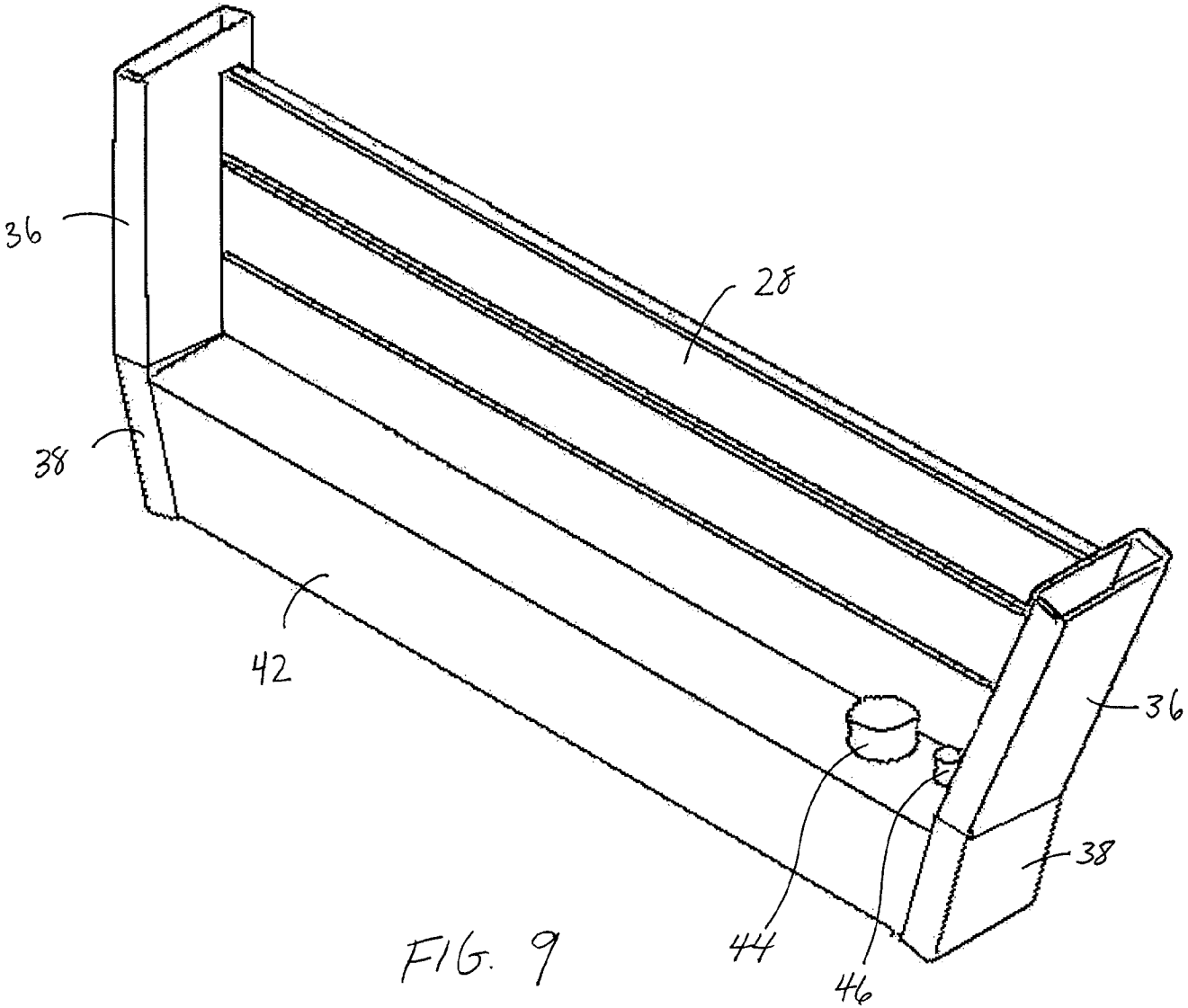
FIG. 9 is a partial perspective view of the stern with a fuel tank connected thereto.

In the embodiment of FIG. 9, a fuel tank assembly 42 is welded to a plurality of rear beams 28 and lower rear posts 36. The fuel tank assembly 42 includes a fuel inlet port 44 and a fuel pick-up port 46. The sizes of each port can vary depending on the type of motor used for driving the cargo skiff. In an exemplary embodiment, the fuel inlet port 44 is a 4 inch dia. threaded male fitting that extends from the surface of the fuel tank assembly 42 by approximately two inches. A threaded fuel cap (not shown) may also be provided for securely fastening to the fuel inlet port 44. The fuel pick-up port 46 may be a 1 inch dia. female fitting onto which a fuel line (not shown) and vent (not shown) are attached. As an example, a 42 inch flexible fuel line may be inserted into the fuel tank assembly 42 and may include a weighted filter attached to the end of the line (which in this embodiment is positioned within the tank assembly). Other embodiments of the fuel tank assembly 42 are possible and thus the above description should not be limiting to the shapes, sizes, and configurations of the fuel tank assembly 42.

Although not shown, a propulsion device, such as a motor or an engine, can be mounted to the stern 14 via brackets, straps, or by other available means known to one skilled in the art. A fuel line may connect between the motor and the fuel pick-up port 46 to supply fuel to the motor. The motor generally is not permanently mounted to the stern so that the cargo skiff 10 can be stacked with other cargo skiffs and shipped in an ocean container as illustrated in FIGS. 10 and 11.

Figure 10:
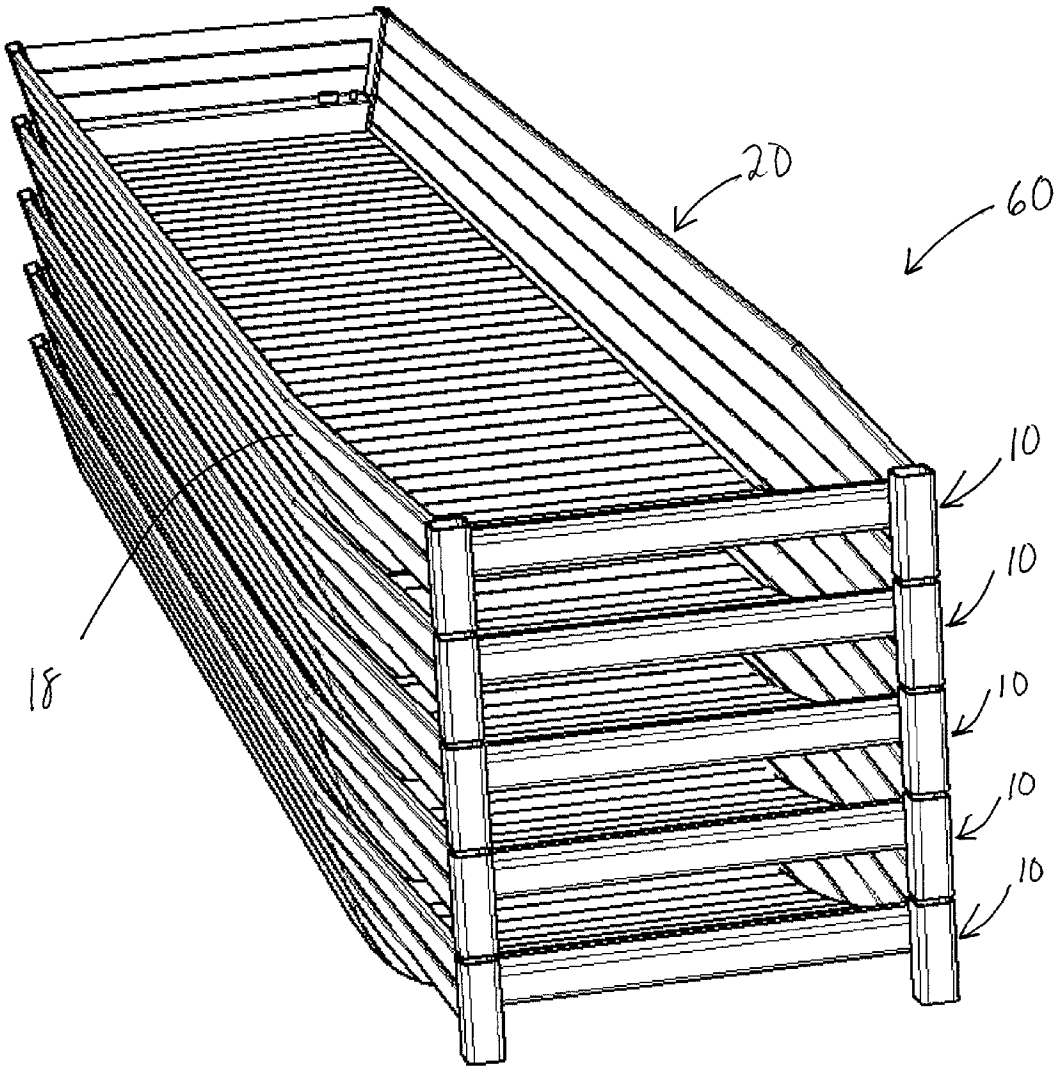
FIG. 10 is a plurality of cargo skiffs stacked one upon another for shipment in a cargo container.

FIG. 10 illustrates a plurality of boats stacked one upon another for shipment in a cargo container. Because the sidewalls of the boat have been angled as previously described, one boat can nest within another boat to provide a stack 60 of boats 10. As further illustrated in FIG. 10, it can be seen that the sides 18 and 20 are slightly bent inward toward the centerline of the skiff as the sides extend toward the front. The bottom tubes are the same length from front to back, but because the bow of the boat ramps up toward the front and the boat sides are angled, the upper side tubes must be bent. The side tubes start their bend radius at the point where the bottom bow tubes are cut to start radiusing toward the front of the boat to create the bow. The lower 2 inch×6 inch side tubes have almost no bend, but at the top, the 3 inch×6 inch rail tube can be bent in approximately 8 inches per side. This provides the top view as illustrated while maintaining the seventy-two inch wide deck through out the length of the craft. This width provides for the loading of vehicles while still allowing stacking of the boats for shipment in the ocean container.

Figure 11:
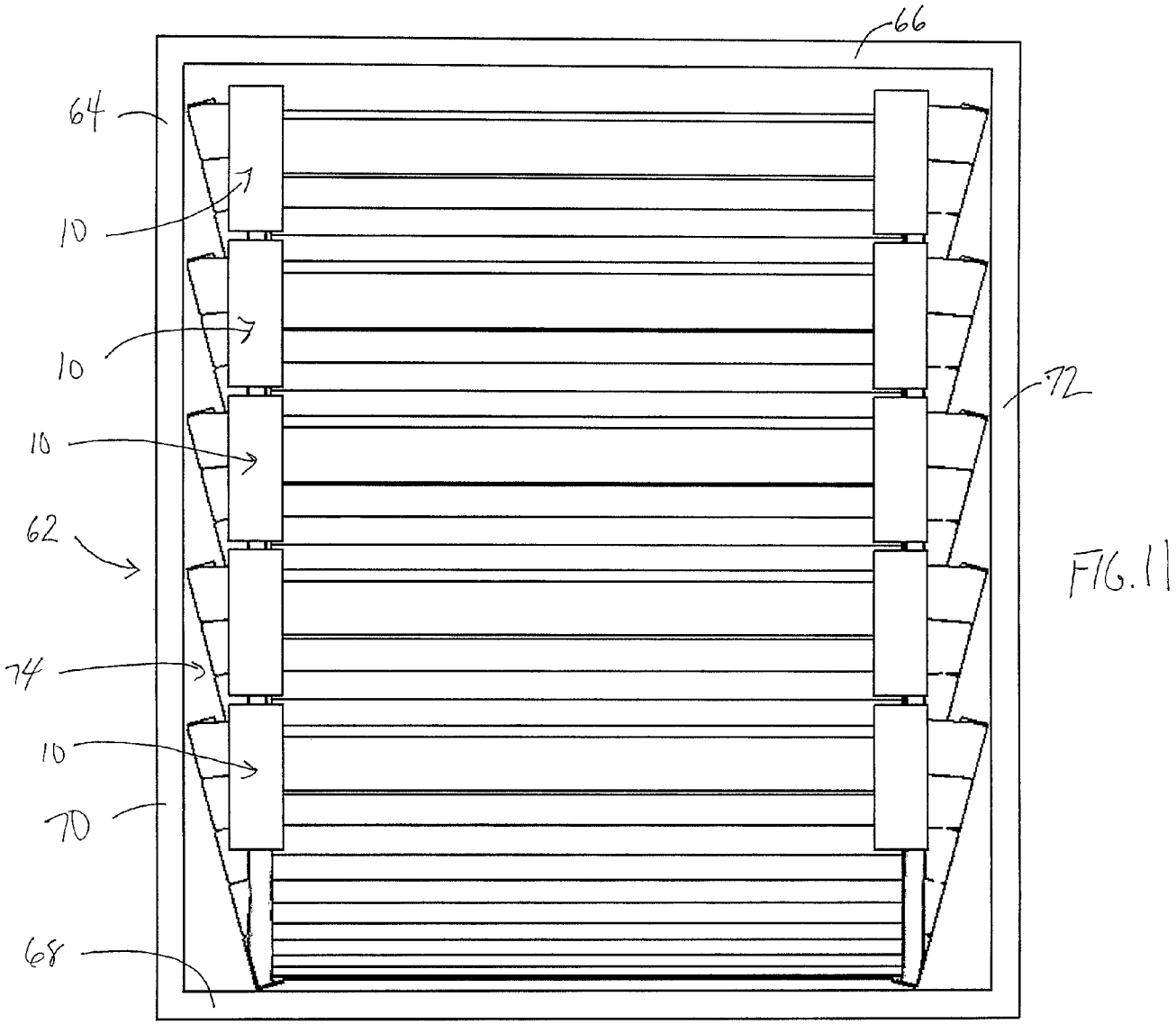
FIG. 11 illustrates an end view of an ocean cargo container including a plurality of cargo skiffs for shipping.

FIG. 11 illustrates an end view 62 of a cargo container 64 which includes a plurality of boats 10 for shipping. The cargo container includes a top 66, a bottom 68, a first side wall 70 and a second side wall 72 to define a standard opening 74. Because ocean cargo containers, as known by those skilled in the art, include a standardized length, width, and height and an opening 74 having a standardized height and width, the cargo skiff of the present invention can be efficiently shipped in the standard ocean cargo containers.

While exemplary embodiments incorporating the principles of the present invention have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A boat having a hull defining a longitudinal axis, a length, a width, an interior and an exterior, comprising:

a first side;

a second side;

a bottom coupled to the first side and the second side; and a back end coupled to the first side, second side, and bottom, each of the first and second sides including a plurality of capped hollow beams forming a plurality of rows extending longitudinally along the boat, each of the plurality of rows being welded along a seam to form a plurality of side weld lines located at an interface between adjoining rows;

wherein, each of the plurality of capped hollow beams within a row includes at least one end welded to an end of an adjacent capped hollow beam on both the interior and exterior of the boat.

2. The boat of claim 1, wherein the each of the hollow beams comprise rectangular steel box tubing.

3. The boat of claim 1, wherein the plurality of side weld lines are located on both the interior and exterior of the boat.

4. The boat of claim 1, wherein each row of the plurality of rows includes a plurality of capped hollow beams.

5. The boat of claim 1, wherein adjacent capped hollow beams within a row form an I-beam design.

6. The boat of claim 1, wherein each of the plurality of hollow beams within a row includes at least one end cap, the at least one end cap sealing off the end of the hollow beam.

7. The boat of claim 6, wherein each of the plurality of hollow beams within a row includes a first end cap and a second end cap to seal off both ends of each of the plurality of hollow beams to provide a substantially airtight hollow beam.

8. The boat of claim 1, wherein the bottom includes a plurality of hollow beams forming a plurality of bottom rows extending substantially perpendicular to the longitudinal axis, each of the plurality of bottom rows being welded along a seam to form a plurality of bottom weld lines located at an interface between adjoining bottom rows.

9. The boat of claim 8, wherein the plurality of bottom weld lines are located on both the interior and exterior of the boat.

10. The boat of claim 9, wherein each of the bottom rows comprise a single hollow beam.

11. The boat of claim 10, wherein each of the bottom rows includes a first end cap and a second end cap to seal off both ends of each of the plurality of hollow beams.

12. A boat having a hull defining a longitudinal axis and a length, a width, an interior and an exterior, the boat comprising:

a first side and a second side, each of the first and second sides including a plurality of hollow beams forming a plurality of adjacent rows extending along the length of the boat, each of the plurality of rows being welded along a seam to form a plurality of side weld lines located at an interface between adjacent rows, wherein each of the plurality of hollow beams within a row includes at least one end welded to an end of an adjacent hollow beam on both the interior and exterior of the boat;

a bottom coupled to the first side and the second side, the bottom including a plurality of bottom rows extending substantially perpendicular to the longitudinal axis, each of the plurality of bottom rows being welded along a seam to form a plurality of bottom weld lines located at an interface between adjoining bottom rows; and a back end coupled to the first side, second side, and bottom.

13. The boat of claim 12, wherein each of the plurality of bottom rows includes at least one hollow beam, each hollow beam including a first end cap and a second end cap to seal off each end of the hollow beam to provide a substantially airtight capped hollow beam.

14. The boat of claim 13, wherein the plurality of hollow side beams within adjacent rows of the first side alternate in quantity and are the same quantity within alternating rows.

15. The boat of claim 13, further comprising a fuel tank, disposed at a rear bottom corner of the boat, the fuel tank forming a portion of the bottom and a portion of back, wherein the fuel tank includes a fuel aperture and a vent aperture to provide fuel to a propulsion device.

16. The boat of claim 15, wherein the fuel tank comprises rectangular steel box tubing.

17. The boat of claim 16, wherein at least one of the hollow beams forming the plurality of bottom rows includes an interior coupled to the fuel tank, to provide for increased fuel capacity.

18. The boat of claim 17, wherein the bottom of the boat defines a horizontal plane and each of the first side and the second side is disposed with respect to the horizontal plane at an angle of approximately 105 degrees, to enable stacking of a plurality of boats for shipment in a cargo container.

19. The boat of claim 13, wherein the plurality of side weld lines and bottom weld lines are located on both the interior and exterior of the boat.

20. The boat of claim 12, wherein adjacent hollow beams within one of the plurality of bottom rows or side rows form an I-beam design.

* * * * *